US012241269B2

(12) United States Patent
Zemke et al.

(10) Patent No.: US 12,241,269 B2
(45) Date of Patent: Mar. 4, 2025

(54) ADAPTER ELEMENT AND MODULAR SYSTEM

(71) Applicant: BENT GmbH, Viersen (DE)

(72) Inventors: Marko Zemke, Bochum (DE); Werner Blum, Cologne (DE)

(73) Assignee: BENT GmbH, Viersen (DE)

( * ) Notice: Subject to any disclaimer, the term of this patent is extended or adjusted under 35 U.S.C. 154(b) by 217 days.

(21) Appl. No.: 17/775,046

(22) PCT Filed: Nov. 7, 2019

(86) PCT No.: PCT/EP2019/080533
§ 371 (c)(1),
(2) Date: May 6, 2022

(87) PCT Pub. No.: WO2021/089151
PCT Pub. Date: May 14, 2021

(65) Prior Publication Data

US 2022/0396968 A1 Dec. 15, 2022

(51) Int. Cl.
*E04H 15/06* (2006.01)
*E04H 15/08* (2006.01)
*E04H 15/64* (2006.01)

(52) U.S. Cl.
CPC ..... *E04H 15/06* (2013.01); *E04H 15/08* (2013.01); *E04H 15/642* (2013.01); *E04H 15/644* (2013.01)

(58) Field of Classification Search
None
See application file for complete search history.

(56) References Cited

U.S. PATENT DOCUMENTS 3,720,438 A * 3/1973 Johnson ..... E04H 15/08 160/46
4,924,895 A * 5/1990 Bailie ..... E04H 15/08 160/67
5,190,066 A * 3/1993 Joergensen ..... E04H 15/08 135/88.13
8,950,145 B2 2/2015 Greiner
(Continued)

FOREIGN PATENT DOCUMENTS

DE 6808827 U 5/1969
DE 2205617 A1 * 8/1973
DE 2259414 A1 * 6/1974
(Continued)

*Primary Examiner* — David R Dunn
*Assistant Examiner* — Danielle Jackson
(74) *Attorney, Agent, or Firm* — The Webb Law Firm

(57) ABSTRACT

The invention relates to an adapter element for fastening a planar element, in particular an awning, to a vehicle, including an adapter body, which has a first edge region for fastening the adapter element to a vehicle, and a second edge region for fastening a planar element to the adapter element. The first edge region of the adapter body is equipped with a vehicle connection element for releasably fastening the first edge region to a vehicle. The second edge region of the adapter body is equipped at the second edge region with a planar element connection element for releasably fastening the second edge region to an edge region of a planar element. The invention also relates to a modular system having such an adapter element and having a planar element.

14 Claims, 11 Drawing Sheets

(56) References Cited

U.S. PATENT DOCUMENTS

| | | | |
|---|---|---|---|
| 10,119,295 | B1 | 11/2018 | Ruffin |
| 10,378,234 | B1 | 8/2019 | Nielsen et al. |

FOREIGN PATENT DOCUMENTS

| | | | | | |
|---|---|---|---|---|---|
| DE | 8230329 | U1 | | 2/1983 | |
| DE | 29802202 | U1 | | 4/1998 | |
| DE | 29724844 | U1 | | 9/2004 | |
| DE | 202004011312 | U1 | | 10/2004 | |
| DE | 102010055461 | B4 | | 7/2013 | |
| DE | 202023000703 | U1 | * | 6/2023 | ..... E04H 15/644 |
| FR | 2527429 | A2 | * | 5/1982 | |
| GB | 926369 | A | * | 5/1963 | |
| GB | 2304083 | A | * | 3/1997 | ..... E04H 15/08 |
| NL | 8006627 | | | 7/1982 | |

* cited by examiner

ADAPTER ELEMENT AND MODULAR SYSTEM

CROSS-REFERENCE TO RELATED APPLICATION

This application is the United States national phase of International Application No. PCT/EP2019/080533 filed Nov. 7, 2019, the disclosure of which is hereby incorporated by reference in its entirety.

BACKGROUND OF THE INVENTION

Field of the Invention

The invention relates to an adapter element for fastening a planar element, in particular an awning, to a vehicle. The invention also relates to a modular system having such an adapter element and having a planar element.

Description of Related Art

A modularly-structured modular system for the design of an overall system built from planar elements is known from DE 20 2004 011 312 U1. The modular system consists of a plurality of planar elements that can be flexibly connected to each other to form a sun or wind protection system, for example. For example, DE 20 2004 011 312 U1 specifies play areas for children, large tents or pavilions as possible exemplary applications for such a modular system.

SUMMARY OF THE INVENTION

The object of the present invention is to extend the scope of such modular systems, in particular to the area of camping.

This object is achieved according to the invention by an adapter element for fastening a planar element, in particular an awning, to a vehicle, comprising an adapter body, which has a first edge region for fastening the adapter element to a vehicle and a second edge region for fastening a planar element to the adapter element, wherein the first edge region of the adapter body is equipped with a vehicle connection element for releasably fastening the first edge region to a vehicle, and wherein the second edge region of the adapter body is equipped at the second edge region with a planar element connection element for releasably fastening the second edge region to an edge region of a planar element.

The vehicle may in particular be a motor vehicle or a motor vehicle trailer, for example a passenger car, a caravan or trailer or a motorhome.

Using such an adapter, a planar element, in particular a planar element of a modular system, can be easily, safely and functionally connected to a vehicle, in particular a passenger car, caravan or motorhome. In this way, the planar element can for example be used as a canopy of a caravan or motorhome or enable a covered transition from a vehicle to a tent. Furthermore, the stability of an overall system composed of planar elements can be improved in this way, since a vehicle ensures a sufficient hold of the planar element even in strong wind, for example.

The object mentioned above is further achieved according to the invention by a modular system comprising the adapter described above and comprising a planar element, wherein the second edge region of the adapter body is adapted to an edge region of the planar element and wherein the edge region of the planar element has a connection element complementary to the planar element connection element for releasably fastening the planar element to the second edge region of the adapter body.

The first edge region of the adapter body is preferably straight. The second edge region of the adapter body can also be substantially straight or curved, for example if it is to be connected to a planar element with a curved edge region.

The first and the second edge region preferably extend over substantially the same width, in particular with a deviation in the width of max. 10%. In this way, a uniform transfer of force between the planar element, adapter element and vehicle can be achieved.

The adapter body preferably has a width of at least 2 m. In this way, a planar element, in particular an awning, of typical size can be fastened to a vehicle by means of an adapter element.

The extension of the adapter body transverse to the extension direction of the first and second edge region is preferably less than 15%, in particular less than 10%, of the width of the adapter body. For example, the adapter body can have an extension of 15 cm or less transverse to the extension direction of the first and second edge region.

The planar element can for example be triangular or quadrangular. Furthermore, the planar element preferably consists substantially of a fabric, in particular a natural and/or plastic fabric, such as for example a PVC or a polyester or a polyester-cotton mix fabric (also referred to as technical cotton). The planar element is preferably equilateral. This increases the flexibility when using the planar element. In particular, a plurality of edge regions of the planar element can be configured for fastening to the adapter element and/or to other planar elements.

Various embodiments of the adapter element and of the modular system are described below, wherein the individual embodiments apply independently of one another to both the adapter element and the modular system. In addition, the individual embodiments can be freely combined with one another.

In one embodiment, the adapter body has or is formed from a fabric, wherein a respective edge region of the fabric preferably forms the first and/or second edge region. In this way, a flexible, in particular foldable, and at the same time robust adapter body is achieved. The fabric can in particular be a plastic fabric, for example made of PVC or polyester.

In a further embodiment, the first edge region and the second edge region of the adapter body are opposite one another and preferably extend substantially over the same length. In this way, the forces transferred from a planar element to the adapter element can be better conducted to the vehicle, in particular over substantially the entire length of the planar element, so that the planar element can be held under tension without creasing.

In a further embodiment, the planar element connection element is formed as a zip side part extending along the second edge region. This makes it easy to fasten a planar element with a complementary zip side part to the adapter element. The zip slide can be provided on the adapter element or on the planar element. A zip connection between the adapter element and the planar element that can be established in this way has the advantage that a uniform transfer of force between the planar element and the adapter element occurs, whereby creases are prevented.

In a further embodiment, the adapter body is equipped at the second edge region with a cover strip covering the planar element connection element, preferably projecting beyond the planar element connection element. A plastic strip can for example be provided as a cover strip. By providing the cover strip, the connection between the adapter element and the planar element can be protected or sealed against rain. If the planar element connection means is designed as a zip side part, the cover strip preferably extends beyond the zip side part such that a complementary zip side part of a planar element is also covered if it is connected to the zip side part of the adapter element.

In a further embodiment, the first edge region of the adapter body is equipped with at least two different vehicle connection elements for releasably fastening the first edge region to a vehicle in each case. In this way, the adapter can be used for different vehicle types by the user using the respectively matching vehicle connection element to connect to the vehicle in question.

In a further embodiment, the first edge region of the adapter body is provided with a keder bead running along the first edge region. In this way, the adapter element can be easily and securely connected to a keder rail on a vehicle. The use of a keder bead also has the advantage that the connection can take place over substantially the entire length of the adapter element, whereby uniform force transfer can be made possible and creases can be prevented.

Preferably, the first edge region of the adapter body is equipped with a double keder bead with two keder beads of different diameters. Different keder rails with different diameters are used on vehicles. By using a double keder bead, the adapter element can be used for vehicles with different keder rails.

In a further embodiment, a keder bead flap is connected to the adapter body at the first edge region, which is guided around a keder bead body and adhered together in an adhesive region between the adapter body and the keder bead body. The keder bead body has in particular a round cross-section and is preferably tubular. The keder bead body forms a keder bead together with the keder bead flap guided around it. The keder bead flap is preferably sewn to the adapter body in order to ensure that the keder bead flap is permanently strongly fastened to the adapter body.

For a double keder bead, the keder bead flap can in particular be guided one after the other around two keder bead bodies, in particular with different diameters, and can be adhered together in an adhesive region adjoining the respective keder bead body.

Preferably, a barring seam extending from the respective narrow side is provided on one or both narrow sides of the keder bead flap in the adhesive region. In this way, the adhesive bond in the adhesive region is prevented from loosening prematurely due to the forces acting during use, which increases the service life of the keder bead and thus of the adapter element. Corresponding seams are preferably provided in the adhesive region between a keder bead body and the adapter body. In the case of a double keder bead with two adhesive regions, the seams can in particular only be provided in the adhesive region closest to the adapter body. However, it is also conceivable to provide corresponding seams in both adhesive regions.

In a further embodiment, the first edge region of the adapter body is equipped with a plurality of fastening straps, in particular Velcro straps, arranged distributed over the width of the first edge region. This enables the adapter to be fastened to a roof railing of a vehicle, for example.

In a further embodiment, the first edge region of the adapter body is equipped with a tunnel extending along the first edge region, which preferably has a plurality of openings arranged distributed over the width of the first edge region. The tunnel is preferably designed as a hollow seam, i.e. the adapter body has a folded and sewn edge, which forms the tunnel along the first edge region. A rod can be inserted through the tunnel into the adapter body, which stabilises the shape of the adapter body. Through the preferably provided openings, connection elements for fastening to a vehicle can also be connected to a rod arranged in the tunnel. The connection elements to be connected to the rod can for example be suction cups which enable fastening to a body panel or window of the vehicle. In one embodiment, the modular system accordingly comprises a rod that can be inserted into the tunnel and connection elements, for example suction cups, which can be mounted through the openings on the rod. The tunnel preferably has at least three, more preferably at least four, openings. In this way, forces from the adapter element can be transferred more uniformly to a vehicle, so that creases are prevented.

Furthermore, a string can also be pulled through the tunnel and tensioned. In this way, stabilisation and fixing of the adapter element can also be achieved.

In a further embodiment, an eyelet is provided at one or both lateral ends of the second edge region, preferably at a respective tab formed by the adapter body. For example, guy ropes can be threaded through the eyelets in order to keep the adapter element under tension. Post tips of support posts can also be inserted through the eyelets to support the adapter element.

The opening of the eyelet is preferably arranged in a line with the planar element connection element. In this way, a force acting on the eyelet from a guy rope or a post tip can be prevented from leading to the connection element warping or opening. Furthermore, such a symmetrical arrangement allows the corresponding arrangement of an eyelet of a planar element such that its eyelets can be placed on top of one another.

Accordingly, in a further embodiment of the modular system, eyelets corresponding to one another are provided at one or both lateral ends of the second edge region of the adapter body and at one or both lateral ends of the edge region of the planar element, the openings of which eyelets are superimposed if the planar element is fastened to the adapter element as intended. This enables joint supporting or bracing of the adapter element and the planar element, whereby the connection between the adapter element and the planar element can be simultaneously held under tension and together.

In a further embodiment, the modular system comprises a plurality of planar elements with edge regions adapted to one another, wherein connection elements corresponding to one another are provided at the edge regions for optionally releasably fastening the planar elements to one another. In this way, a plurality of planar elements can be optionally and flexibly fastened to one another, so that a desired overall system in the desired shape and size results. The second edge region of the adapter element and the planar elements are preferably adapted to one another such that the second edge region can be connected to edge regions of different planar elements. This increases the flexibility of the modular system.

BRIEF DESCRIPTION OF THE DRAWINGS

Further advantages and features of the adapter element and of the modular system emerge from the following description of exemplary embodiments, with reference being made to the attached drawing.

In the drawing

DESCRIPTION OF THE INVENTION

Figure 1A:
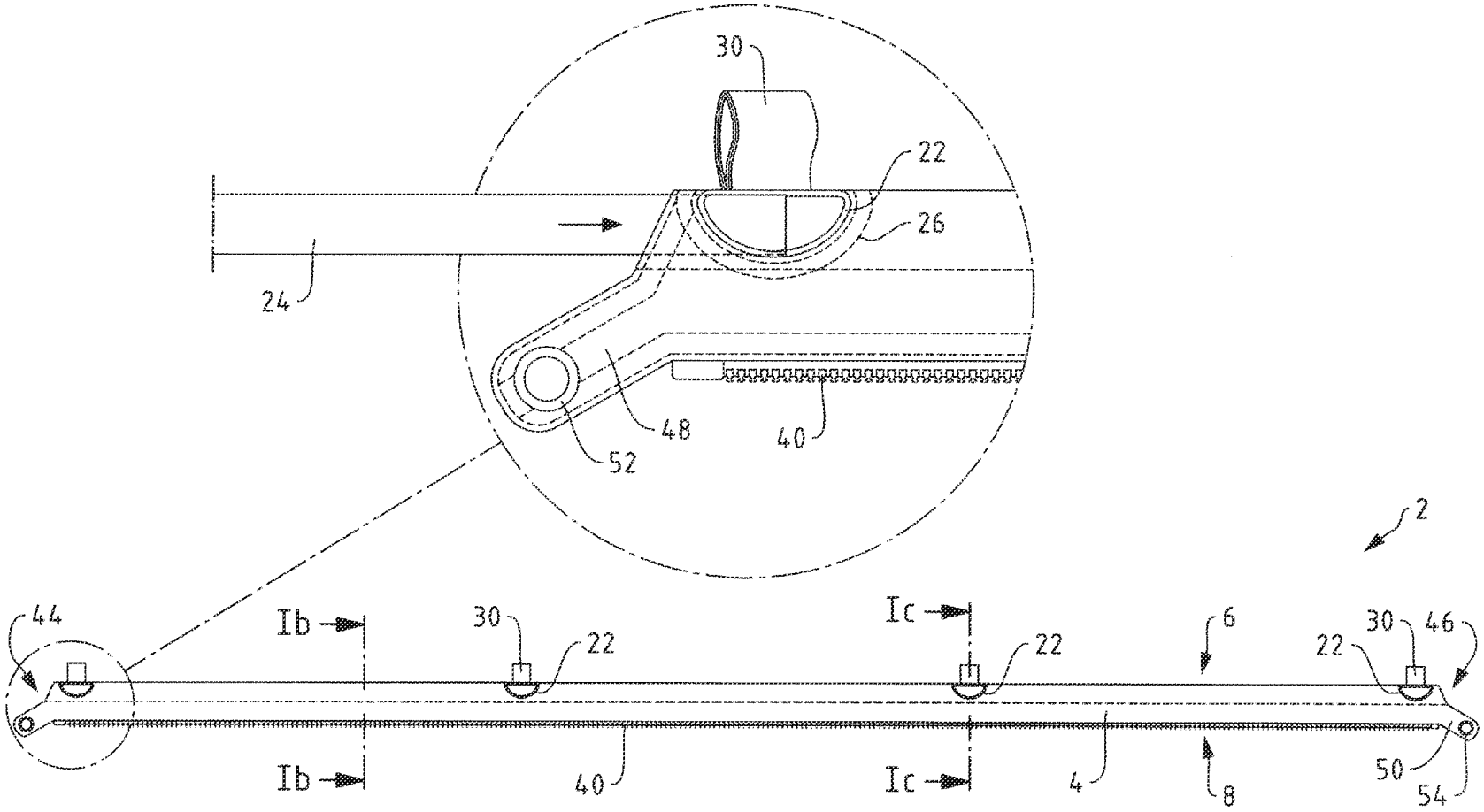
FIG. 1*a-d* show an exemplary embodiment of an adapter element according to the present invention.
Figure 1B:
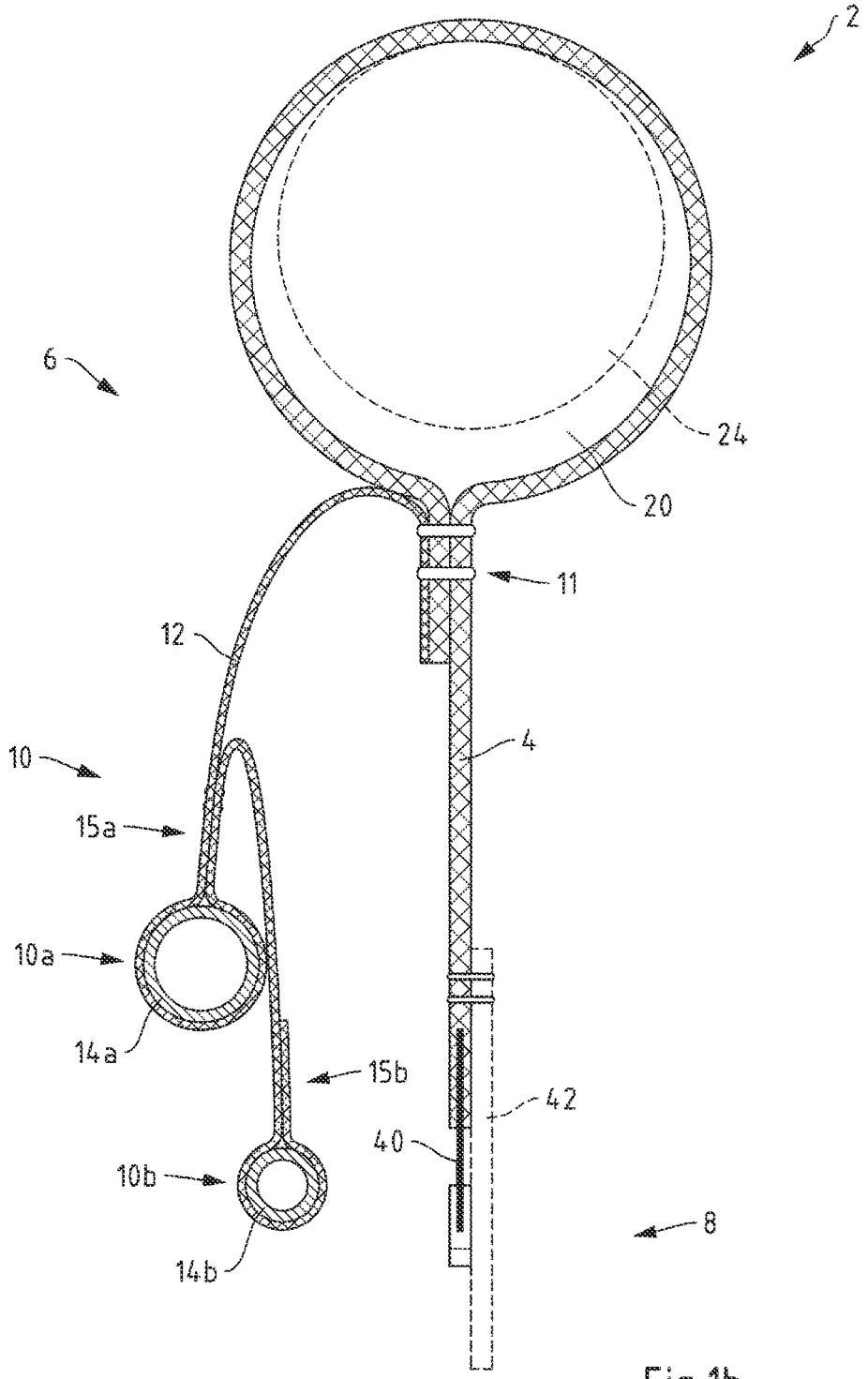
Figure 1C:
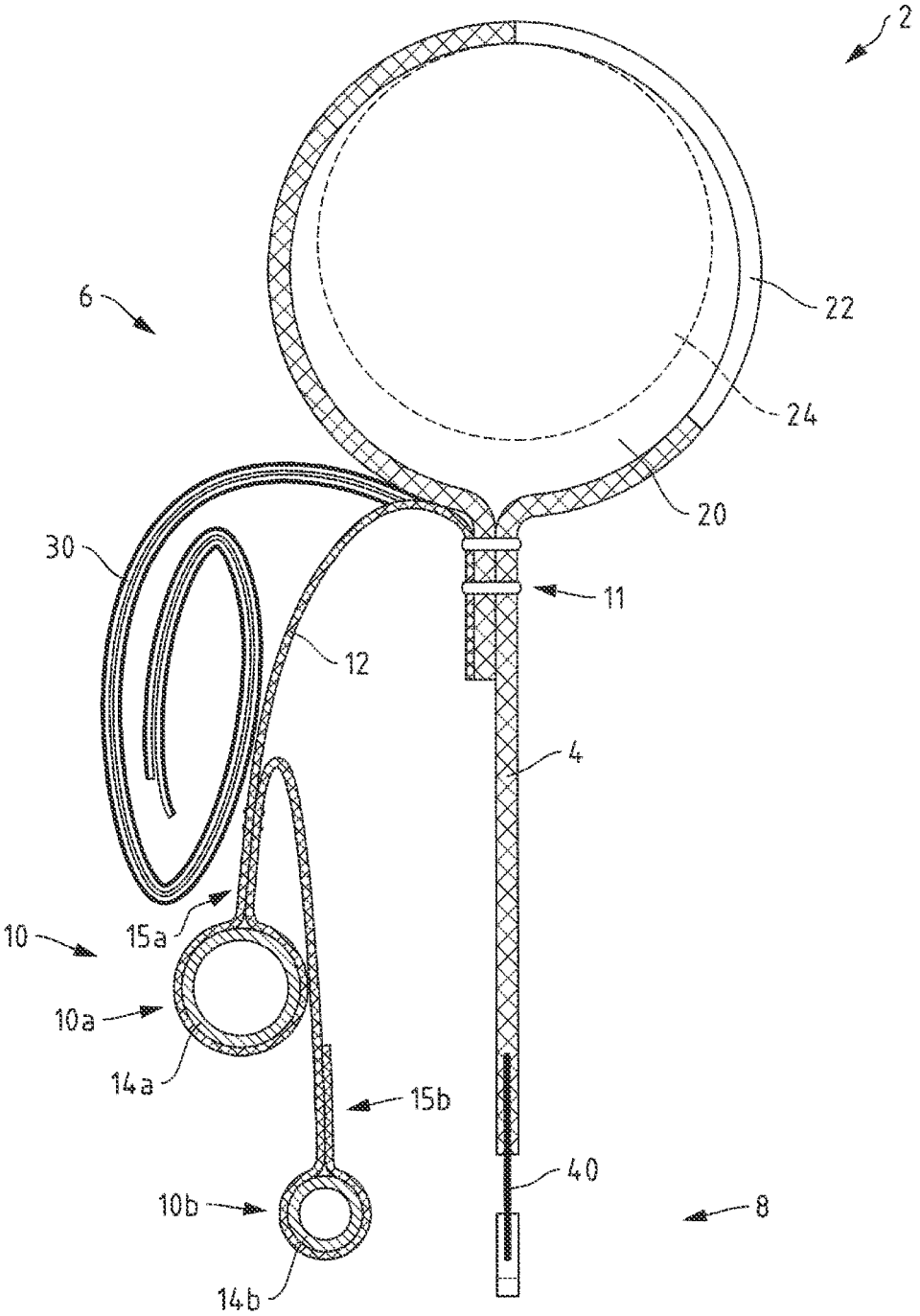
Figure 1D:
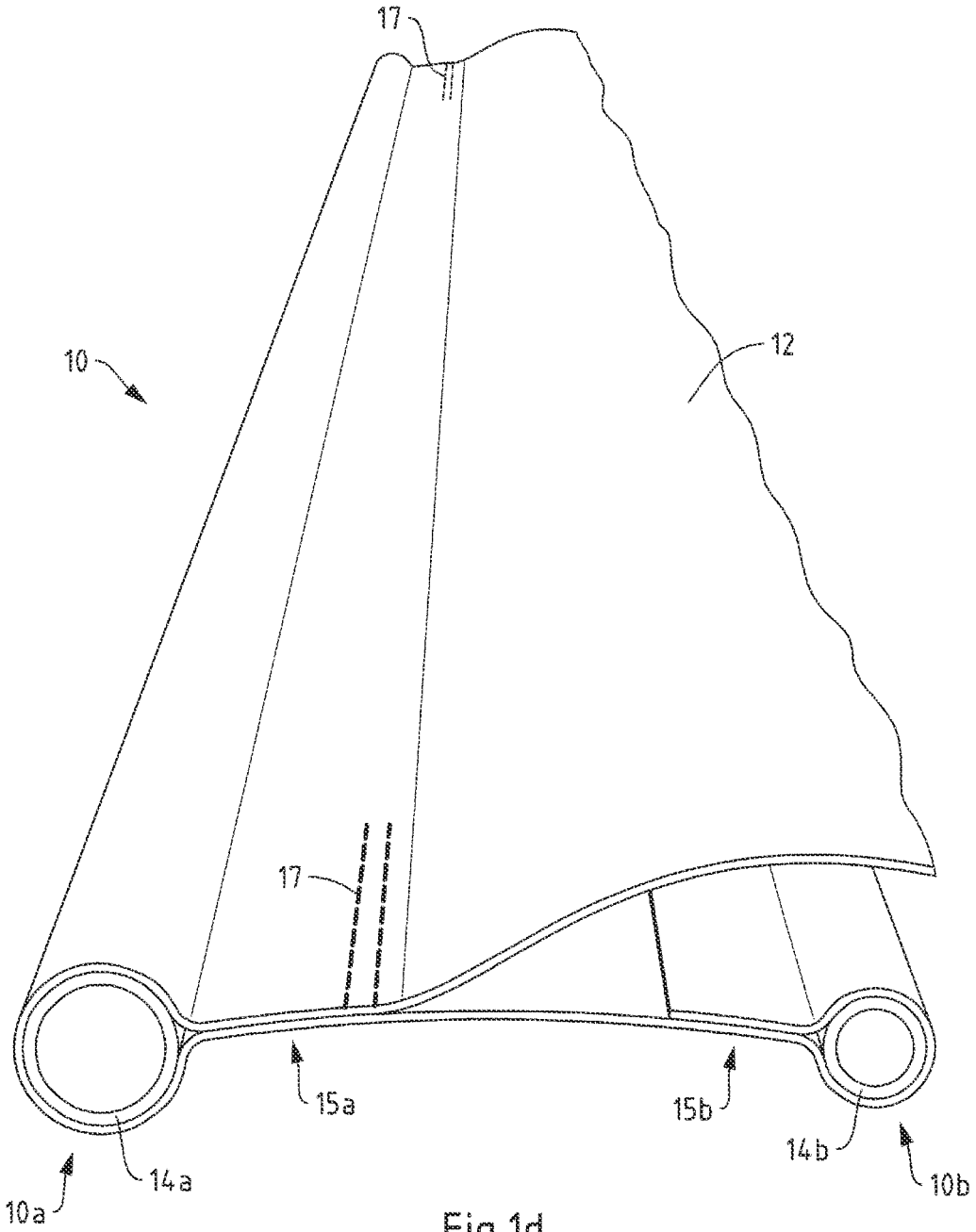

FIG. 1*a-d* show an exemplary embodiment of an adapter element for fastening a planar element, in particular an awning, to a vehicle in a schematic representation. FIG. 1*a* shows a view, FIG. 1*b-c* show sectional views corresponding to the section planes drawn and marked with "Ib" or "Ic" in FIG. 1*a* and FIG. 1*d* shows a perspective representation of the double keder bead of the adapter element.

The adapter element 2 comprises an elongated adapter body 4 made of a plastic fabric, for example of polyester or PVC fabric. The adapter body 4 has a first edge region 6 for fastening the adapter element 2 to a vehicle and a second edge region 8 for fastening a planar element, for example an awning, to the adapter element 2.

The first edge region 6 of the adapter body 4 is equipped with different connection elements for releasably fastening the first edge region to a vehicle:

First, the first edge region 6 is equipped with a double keder bead 10 running along the first edge region 6. For this purpose, a keder bead flap 12 in the form of a fabric strip is sewn onto the adapter body 4 (seam 11). The keder bead flap 12 is guided around two tubular keder bead bodies 14*a-b* with different diameters and adhered together in the respective adhesive region 15*a* or 15*b* adjoining the keder bead bodies 14*a-b* such that two keder beads 10*a-b* with different diameters result. By inserting one of the keder beads 10*a-b* into a keder rail (82 in FIG. 3*b*) provided on a vehicle, the adapter element 2 can be fastened to the vehicle. By providing a double keder bead 10 with two keder beads 10*a-b* with diameters of different sizes, the keder bead suitable for the respective keder rail can be selected.

FIG. 1*d* shows the double keder bead 10 in perspective view, wherein the connection with the adapter body 4 has been hidden for the sake of clarity. It has been found that the adhesive region 15*a*, from which the keder bead flap 12 extends to the adapter body 4, is exposed to great stresses during use, such that an early failure of the adhesive bond can occur. It was further found that this problem can be remedied by providing the keder bead flap in the adhesive region 15*a* with a barring seam 17. It is not necessary for the barring seam 17 to extend along the entire adhesive region 15*a*. In fact, it was determined that it is sufficient for a barring seam 17 extending from the respective narrow side to be provided on both narrow sides of the keder bead flap 12 in the adhesive region 15*a*.

Furthermore, the first edge region 6 of the adapter body 4 is equipped with a tunnel 20 with openings 22 arranged distributed over the width of the first edge region 6. In the case of the adapter element 2, the tunnel 20 is formed by a part of the adapter body 4, which is sewn together at the first edge region 6 as a hollow seam (seam 11). The tunnel 20 extends along the width of the first edge region and is opened at one or both ends so that a rod 24 can be inserted into the tunnel. The rod 24 is accessible from the outside at the openings 22 so that further connection elements, in particular suction cups, can be mounted on the rod with which the adapter element 2 can be fastened to a vehicle. The adapter body 4 is preferably reinforced in the region of the openings 22, in particular through seams 26, in order to avoid the adapter body 4 tearing in the region of the openings 22.

Instead of a rod 24, a string can also be pulled through the tunnel 20 and tensioned. In this way, a stabilisation and fixing of the adapter element 2 can also be achieved.

Furthermore, the first edge region 6 of the adapter body 4 is equipped with a plurality of fastening straps 30, in particular Velcro straps, arranged distributed over the width of the first edge region 6, with which the adapter body 4 can be fastened, for example, to a roof railing of a vehicle. The fastening straps 30 can for example be sewn with the adapter body 4 in the region of the openings 22.

Due the first edge region 6 being fitted with different connection elements as previously described, the adapter element 2 can be flexibly connected to different vehicles, wherein in each case the connection elements suitable for the vehicle in question can be used.

The adapter body 4 is further equipped at the second edge region 8 with a planar element connection element 40 for releasably fastening the second edge region to an edge region of a planar element. In the case of the adapter element 2, the planar element connection element 40 is designed as a zip side part extending along the second edge region 8, with which the adapter element 2 can be connected to a planar element which has a corresponding zip side part.

The adapter body 4 can be equipped at the second edge region 8 with a cover strip 42 extending along the second edge region 8 and covering the planar element connection element 40 and projecting beyond this (illustrated by way of example in FIG. 1*b* with dashed lines). In this way, the planar element connection element 40 and a corresponding connection element of the planar element connected thereto can be sealed against rain.

At the lateral ends 44, 46 of the second edge region 8, the adapter body 4 in each case has a tab 48, 50 with a respective eyelet 52, 54 through which, for example, guy ropes can be threaded in order to tension the adapter element.

The opening of the eyelets 52, 54 are arranged in line with the zip side part 40. If the adapter element is tensioned through the eyelets 52, 54, this position of the eyelets reduces forces acting transversely on the zip side part 40 and thus facilitates actuation of the zip. In addition, this position makes it possible to overlap the eyelets 52, 54 with the respective eyelets of a planar element connected to the adapter element 2.

Figure 2:
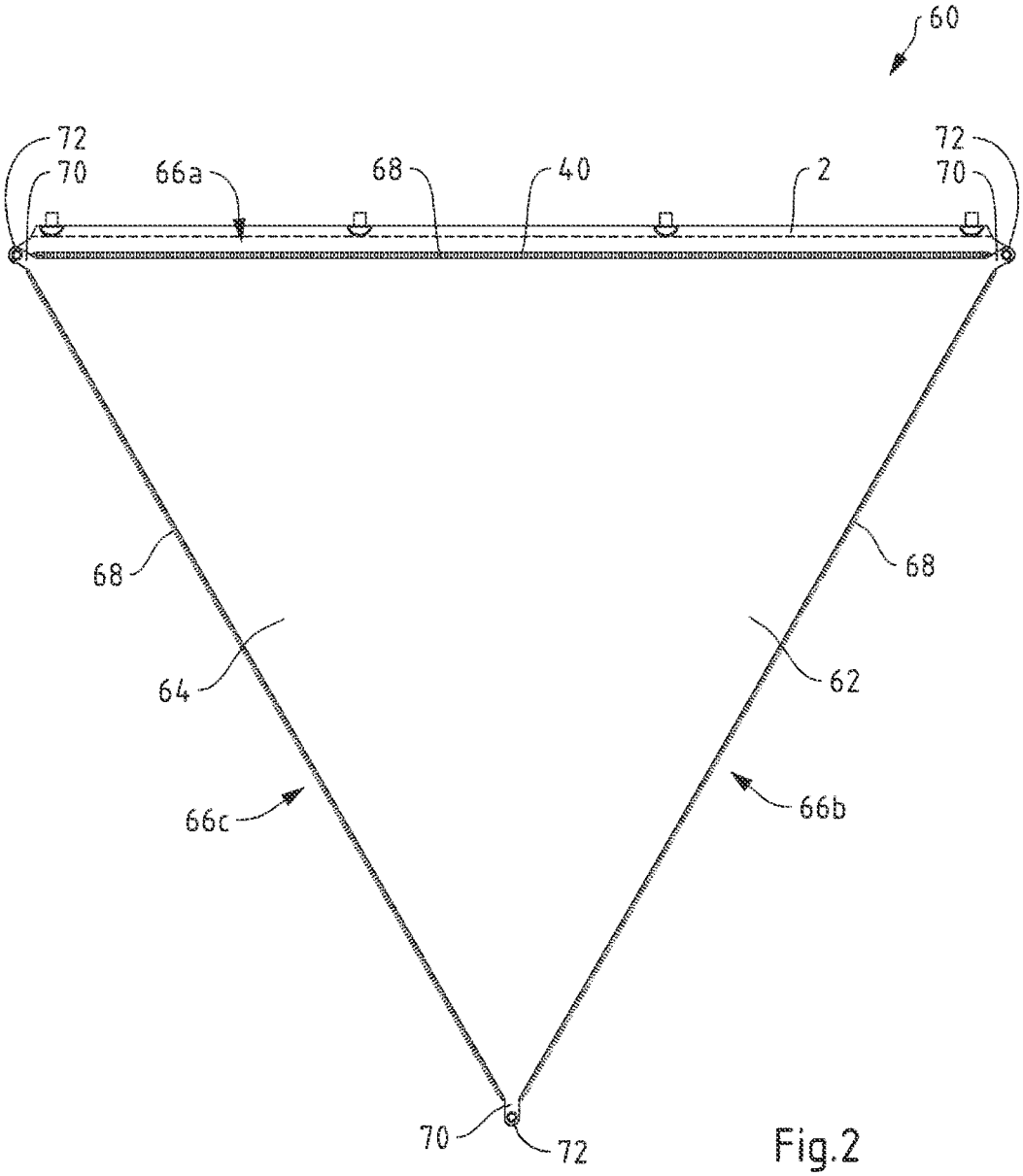
FIG. 2 shows an exemplary embodiment of the modular system according to the present invention.

FIG. 2 now shows an exemplary embodiment of the modular system with the adapter element 2 from FIG. 1*a-b* in schematic representation.

The modular system 60 comprises the adapter element 2 and one or a plurality of planar elements, of which in FIG. 2 one planar element 62 is shown.

The planar element 62 has a planar body 64, which is preferably formed from a plastic fabric, for example polyester or PVC. The planar body 64 has a triangular shape, in particular with side edges of equal length, and accordingly has three edge regions 66*a-c* at the three side edges. Alternatively, quadrangular or polygonal planar elements are also conceivable. Planar elements with curved side edges are also conceivable. However, the triangular shape is preferred, since it offers the greatest design freedom when connecting a plurality of planar elements.

On the three side edges, the planar body 64 is in each case equipped with connection elements 68 extending along the edge regions 66*a-c* in the form of a zip side part. Zip slides are also provided on some of the zip side parts.

The connection element 68 on at least one of the side edges of the planar element 62 is adapted to the planar element connection element 40 of the adapter element 2 such that, as shown in FIG. 2, they can be releasably connected to one another. The planar element 62 can be connected to similar planar elements 62 using the connection elements 68 on the remaining side edges in order to obtain an overall system with the desired shape, for example as sun protection. The adapter element 2 enables the simple and secure fastening of this overall system to a vehicle and thus simplifies its design and increases its stability.

The planar element 62 has respective tabs 70 with eyelets 72 at its three corners. The eyelets are positioned such that their openings are in a line with the zip side parts 68 of the adjoining side edges. In this way, the eyelets 52, 54 of the tabs 48, 50 of the adapter element 2 lie exactly over two eyelets 72 of the tabs 70 of the planar element 62, so that a guy rope can be threaded through two eyelets on top of one another and the adapter element 2 and the planar element 62 can be tensioned together.

Figure 3A:
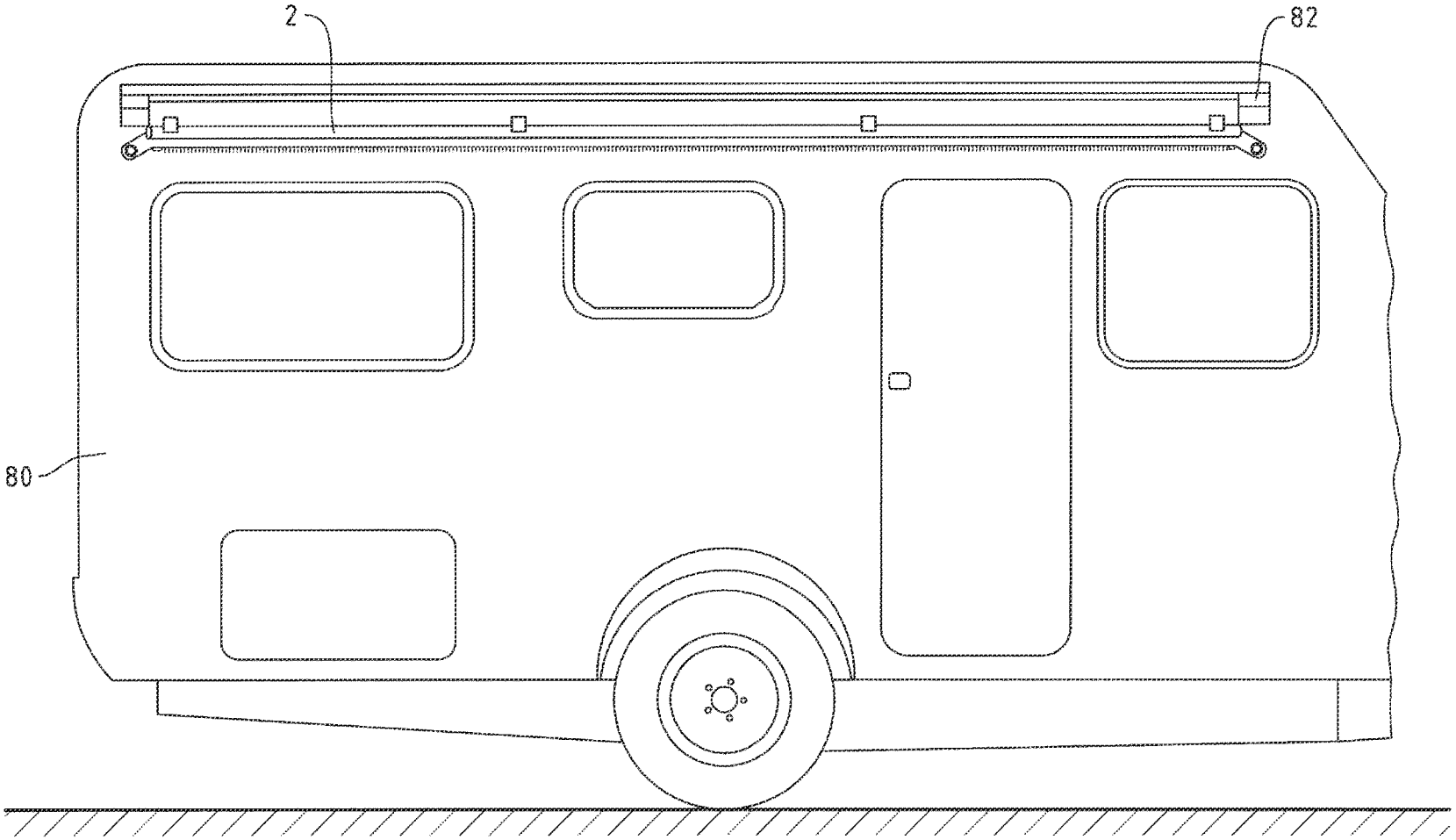
FIG. 3*a-b* show a fastening of the adapter element from FIG. 1 to a vehicle.
Figure 3B:
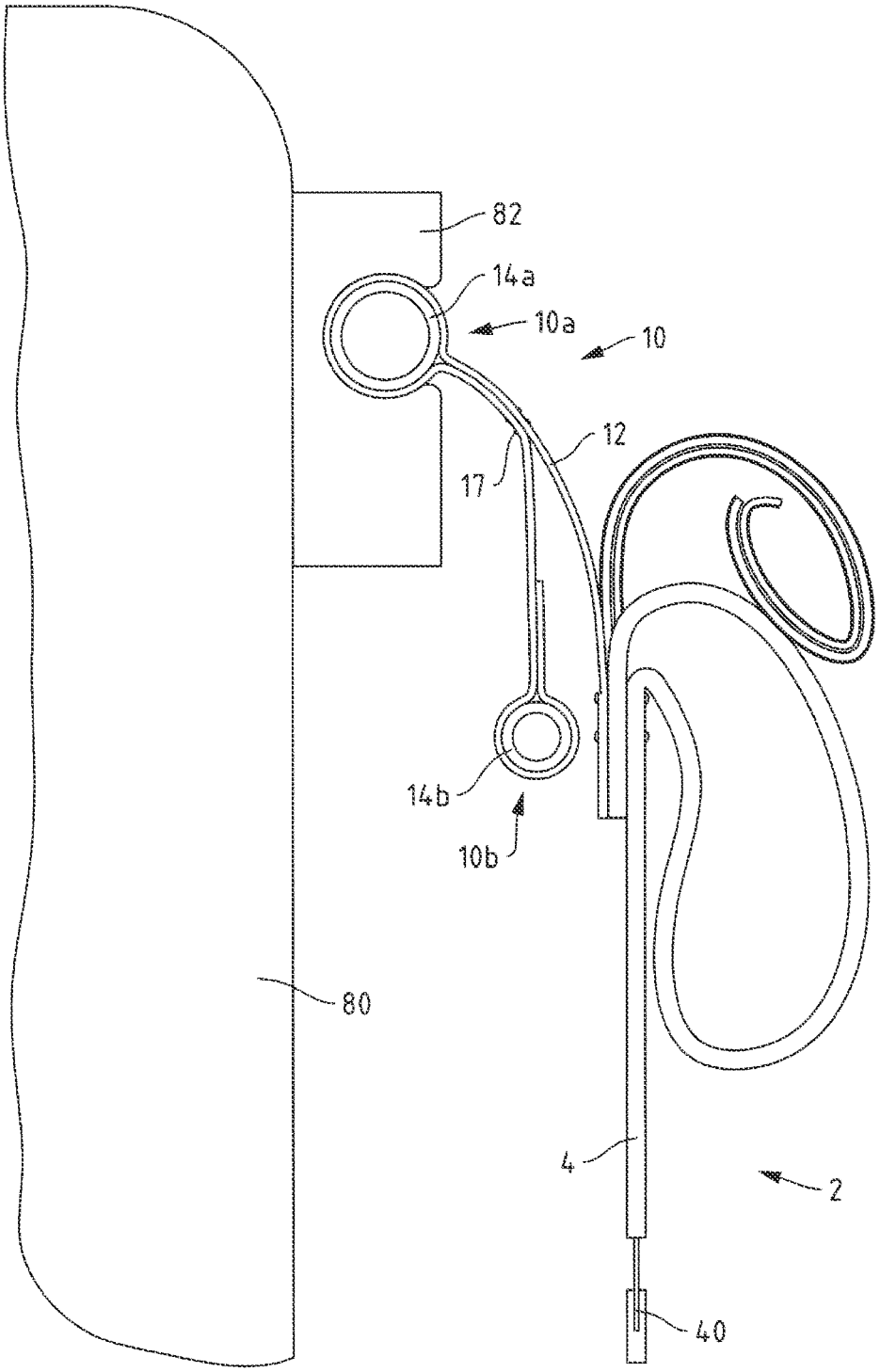

FIG. 3*a-b* show in a schematic representation a possible fastening of the adapter element 2 from FIG. 1 to a vehicle. FIG. 3*a* shows a side view of the vehicle 80 with adapter element fastened thereto and FIG. 3*b* shows a sectional view on the rear of the vehicle. In this example, the vehicle 80 is a caravan. Alternatively, the vehicle 80 can, however, also be a passenger car, for example.

A keder rail 82 runs on one side of the vehicle 80 above the vehicle door and vehicle windows. Such keder rails are common in caravans or motorhomes, for example. In order to fasten the adapter element 2 to the vehicle 80, the keder bead 10*a* of the double keder bead 10 is pushed or pulled into the keder rail 82. Using the planar element connection element 40, a planar element, such as for example the planar element 62 from FIG. 2, can be fastened to the adapter element 2 and in this way can be easily and securely fastened to the vehicle 80. In this way, for example, an awning can be attached directly to a vehicle 80 equipped with a keder rail.

Figure 4A:
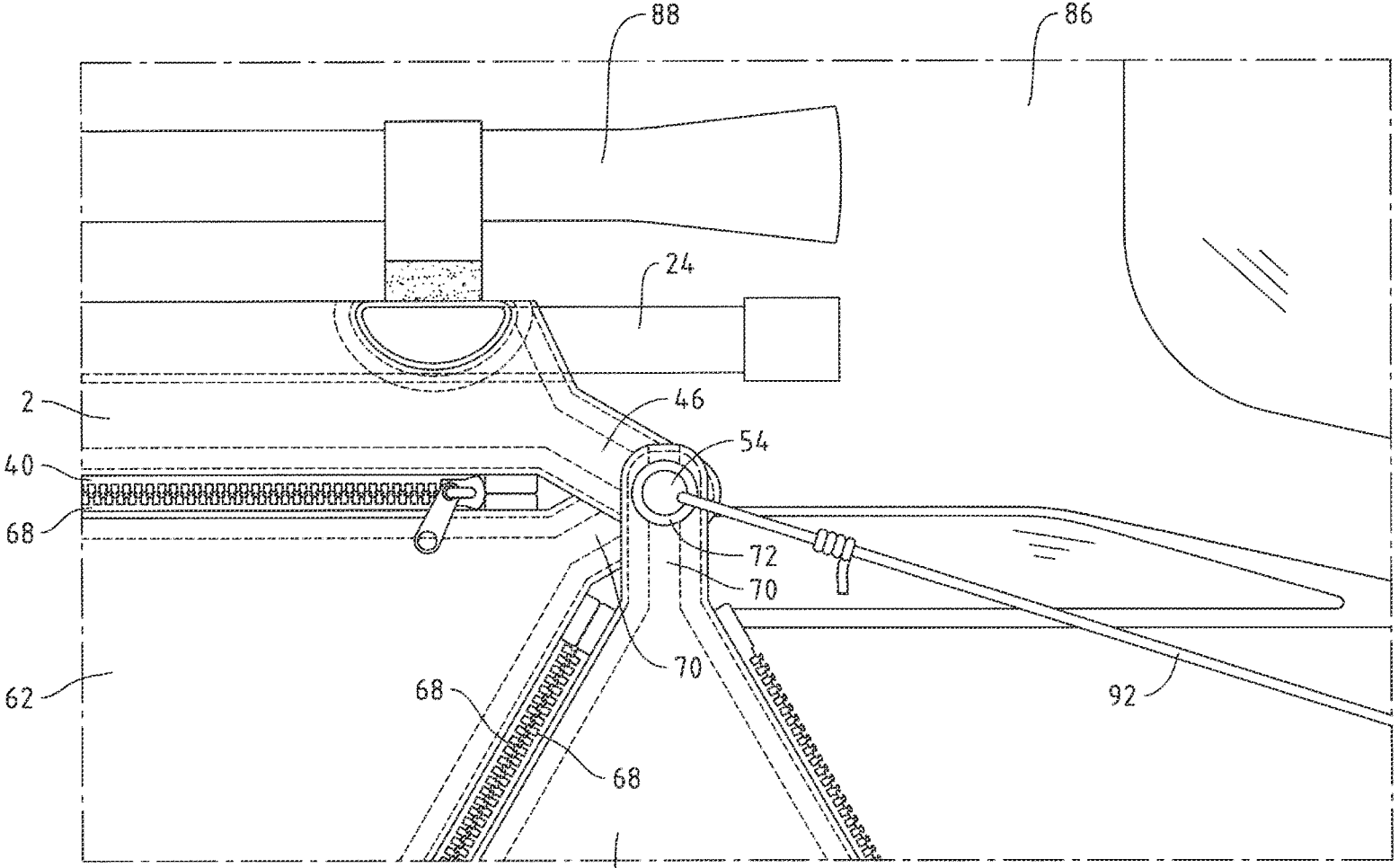
FIG. 4*a-b* show an alternative fastening of the adapter element from FIG. 1 to a vehicle and FIG. 5*a-b* show a further alternative fastening of the adapter element from FIG. 1 to a vehicle.
Figure 4B:
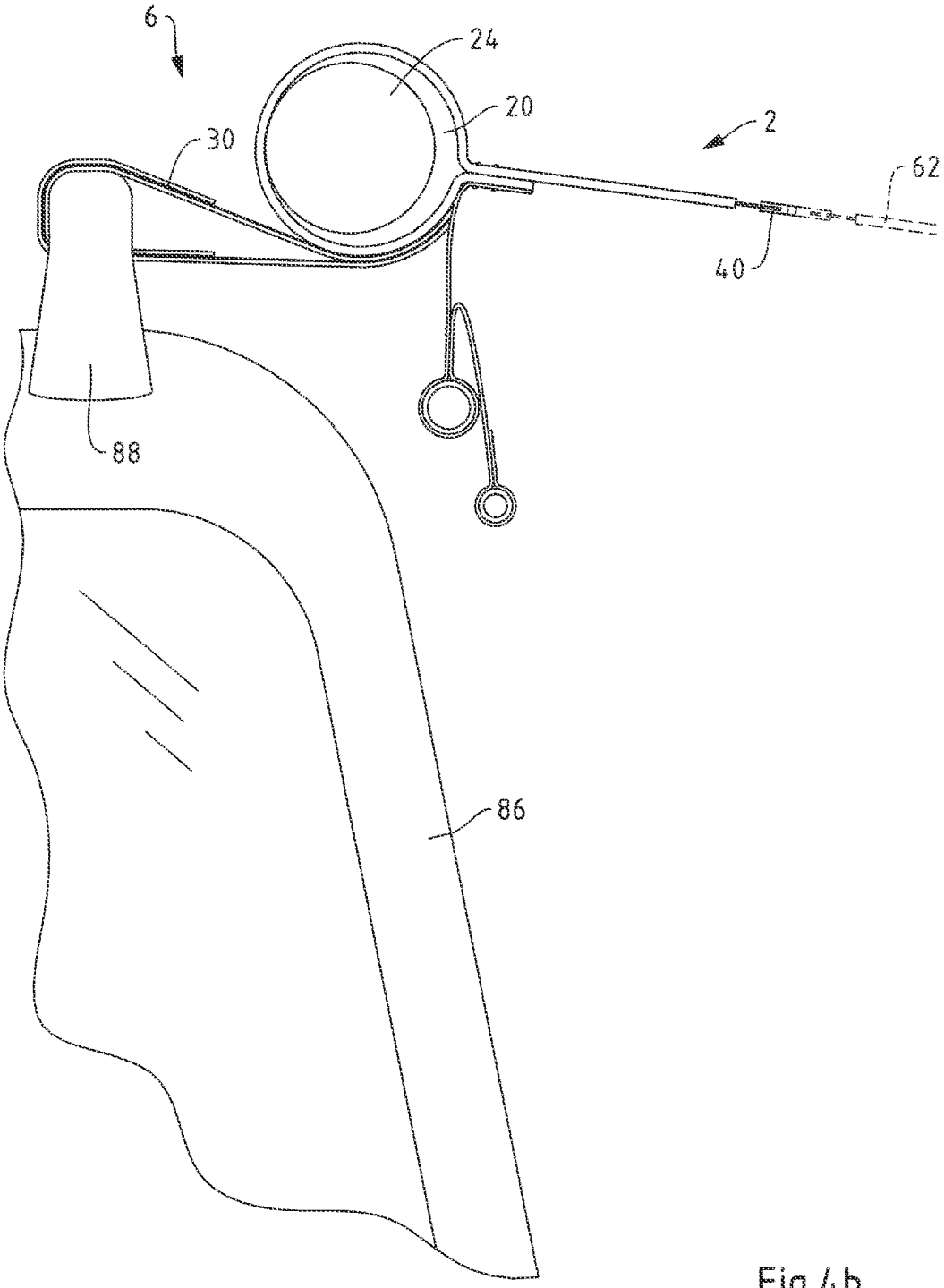

FIG. 4*a-b* show in a schematic representation an alternative fastening of the adapter element 2 from FIG. 1 to a vehicle 86 with a roof railing 88 extending on the roof of the vehicle 86 along one side of the vehicle, for example a passenger car. FIG. 4*a* shows a sectional view and FIG. 4*b* a sectional view on the rear of the vehicle.

Various passenger cars have such roof railings. To fasten the adapter element 2 to the vehicle 86, the Velcro straps 30 arranged distributed over the width of the first edge region 6 are placed around the roof railing. For additional tightening of the adapter element 2, a rod 24 can also be pushed into the tunnel 20. Using the planar element connection element 40, a planar element 62 can then be easily and securely fastened to the adapter element 2 and thus to the vehicle 86. In this way, for example, an awning can be attached directly to a vehicle with a roof railing.

A guy rope 92 can be threaded through the overlapping eyelets 54 and 72 of the adapter element 2 and of the planar element 62 in order to tension the adapter element 2 and planar element 62.

Figure 5A:
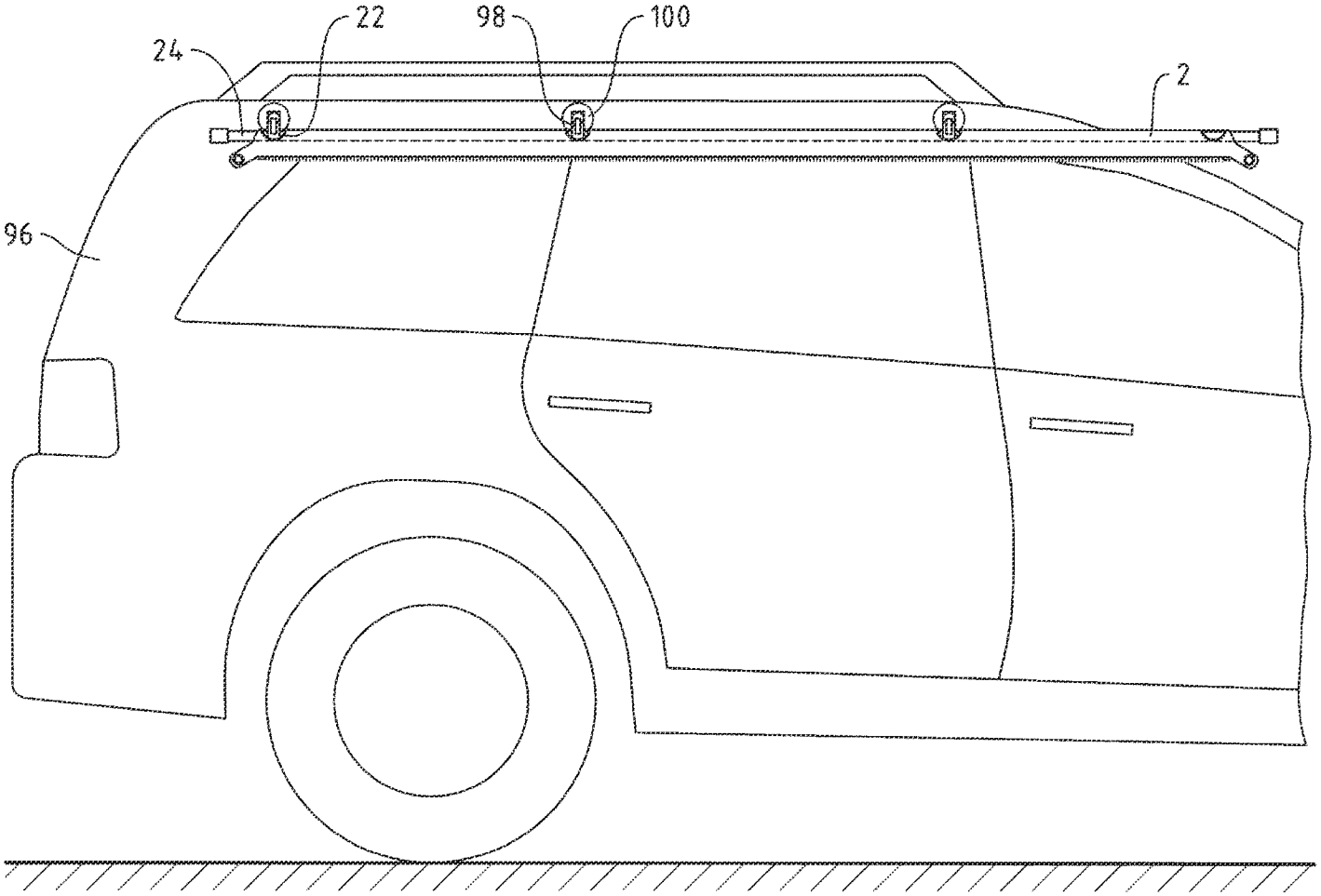
Figure 5B:
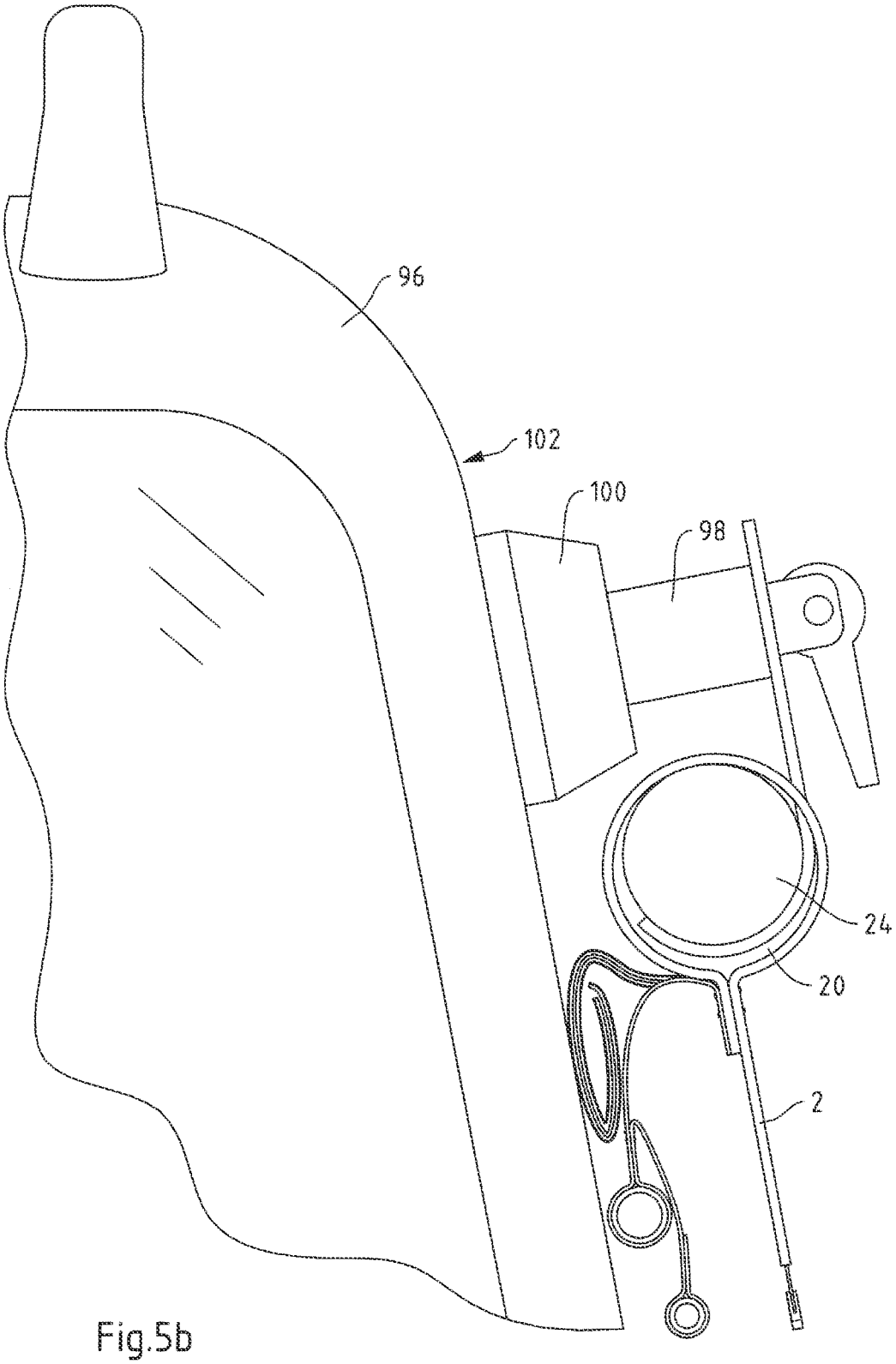

FIG. 5*a-b* show in a schematic representation a further alternative fastening of the adapter element 2 from FIG. 1 to a vehicle 96. FIG. 5*a* shows a sectional side view and FIG. 5*b* a sectional view on the rear of the vehicle.

The vehicle 96 has neither a keder rail nor a suitable roof railing. To fasten the adapter element 2 to such a vehicle, a rod 24 is first pushed into the tunnel 20. Suitable connection elements for fastening to the vehicle 96 can then be connected to the rod 24 through the openings 22. In FIG. 5*a-b*, suction cups 100 are connected by means of mechanical coupling means 98 to the rod 24, which, as shown in FIG. 5*b*, can be placed on an outer surface 102, for example on a body panel or window of the vehicle 96. In this way, the adapter element 2 and thus also a planar element that can be fastened thereto can also be fastened to a vehicle which has neither a keder rail nor a suitable roof railing.

The invention claimed is:

1. An adapter element for fastening a planar element, in particular an awning, to a vehicle, said adapter element comprising an adapter body, which has a first edge region for fastening the adapter element to a vehicle and a second edge region for fastening a planar element to the adapter element, wherein the first edge region of the adapter body is equipped with at least two vehicle connection elements for releasably fastening the first edge region to a vehicle in each case, the at least two vehicle connection elements being of different kinds, wherein the second edge region of the adapter body is equipped at the second edge region with a planar element connection element for releasably fastening the second edge region to an edge region of a planar element.

2. The adapter element according to claim 1, wherein the adapter body has or is formed from a fabric, wherein a respective edge region of the fabric forms the first or second edge region.

3. The adapter element according to claim 1, wherein the first edge region and the second edge region of the adapter body are opposite one another and preferably extend substantially over the same length.

4. The adapter element according to claim 1, wherein the planar element connection element is designed as a zip side part extending along the second edge region.

5. The adapter element according to claim 1, wherein the adapter body is equipped at the second edge region with a cover strip covering the planar element connection element the cover strip projecting beyond the planar element connection element.

6. The adapter element according to claim 1, wherein a keder bead flap is connected to the adapter body at the first edge region, which is guided around a keder bead body and is adhered together in an adhesive region between the adapter body and the keder bead body, and in that a barring seam extending from a respective narrow side of the keder bead flap is provided on one or both narrow sides of the keder bead flap in the adhesive region.

7. The adapter element according to claim 1, wherein the first edge region of the adapter body is equipped with a plurality of fastening straps, arranged over the width of the first edge region.

8. The adapter element according to claim 1, wherein the first edge region of the adapter body is equipped with a tunnel extending along the first edge region, which preferably has a plurality of openings arranged over the width of the first edge region.

9. The adapter element according to claim 1, wherein an eyelet is provided at one or both lateral ends of the second edge region.

10. The adapter element according to claim 9, wherein an opening of the eyelet is arranged in a line with the planar element connection element.

11. An adapter element for fastening a planar element, in particular an awning, to a vehicle, said adapter element comprising an adapter body, which has a first edge region for fastening the adapter element to a vehicle and a second edge region for fastening a planar element to the adapter element, wherein the first edge region of the adapter body is equipped with a vehicle connection element for releasably fastening the first edge region to a vehicle, wherein the first edge region of the adapter body is equipped with a double keder bead with two keder beads of different diameters running along the first edge region; and, wherein the second edge region of the adapter body is equipped at the second edge region with a planar element connection element for releasably fastening the second edge region to an edge region of a planar element.

12. A modular system, comprising an adapter element according to claim 1 and a planar element, wherein the second edge region of the adapter body is adapted to an edge region of the planar element and wherein the edge region of the planar element has a connection element complementary to the planar element connection element for releasably fastening the planar element to the second edge region of the adapter body.

13. The modular system according to claim 12, wherein eyelets corresponding to one another are provided at one or both lateral ends of the second edge region of the adapter body and at one or both lateral ends of the edge region of the planar element, each eyelet having a respective opening, wherein the openings of the respective eyelets at the one or the both lateral ends are superimposed if the planar element is fastened to the adapter element as intended.

14. The modular system according to claim 12, further comprising a plurality of planar elements with edge regions adapted to one another, wherein connection elements corresponding to one another are provided at the edge regions for optionally releasably fastening the planar elements to one another.

* * * * *